US006058681A

United States Patent [19]

Recchia, Jr.

[11] Patent Number: 6,058,681

[45] Date of Patent: May 9, 2000

[54] METHOD OF MAKING HEAT SEALED PRODUCE BAGS

[75] Inventor: Michael J. Recchia, Jr., Roselle, Ill.

[73] Assignee: Tagit Enterprises Corporation, Chicago, Ill.

[21] Appl. No.: 08/804,431

[22] Filed: Feb. 21, 1997

[51] Int. Cl.[7] ..... B65B 43/04

[52] U.S. Cl. ..... 53/455; 53/477; 53/373.5

[58] Field of Search ..... 53/455, 562, 459, 53/477, 479, 481, 547, 370.4, 370.5, 373.4, 373.5

[56] References Cited

U.S. PATENT DOCUMENTS

| | | | |
|---|---|---|---|
| 3,319,538 | 5/1967 | Bodolay et al. | 53/455 X |
| 3,817,017 | 6/1974 | Titchenal | 53/459 X |
| 5,722,217 | 3/1998 | Cloud | 53/455 |

*Primary Examiner*—Linda Johnson

*Attorney, Agent, or Firm*—Gerstman, Ellis & McMillin, Ltd.

[57] ABSTRACT

A method is provided for bagging produce in sealed bags in an automated manner. The method comprises the following steps. A pair of thermoplastic sheets are advanced along a process line with the sheets being in parallel, abutting relation. A longitudinal seal line is formed between the sheets near to but spaced from the lower edges thereof to define a bag header. Transverse slits are formed in both of the sheets together, with the edges of the slits being heat sealed, as with a hot knife, to form separate bags between the slits. The slits extend across the lower edges of the sheets, but are spaced from the upper edges. Thus, the sheets remain integral despite the formation of multiple bags therein. Produce is dropped between the thermoplastic sheet upper edges into the bag. The bags then may be horizontally slit to substantially intersect the transverse slits and to separate a horizontal strip of the sheets including the upper edges, while bottom-supporting the bags. Following this, the bags are heat sealed along the new upper edges formed by the horizontal slitting. By this process, bags with top headers may be manufactured and filled by an automated process.

7 Claims, 4 Drawing Sheets

84
64
62
63
58
70
32
56
52
54
58
30
68
56
48
30
47

80
70
72
72
76
58
78
74
56
78

METHOD OF MAKING HEAT SEALED PRODUCE BAGS

BACKGROUND OF THE INVENTION

Bags for produce such as apples, potatoes, onions, and other primarily vegetable products are often made from plastic sheeting, being formed, filled, and heat sealed with a variety of semi-automated processes. For example, a conventional form and fill machine for such bags is manufactured by the Affeldt Company of Germany and distributed by APM Inc. of Norcross, Ga. This machine provides a continuous line from which bags are formed out of plastic sheeting, and filled. They then may be cut and sealed by hand labor, to provide the separated bags, using, for example, a Ban Rite horizontal slitter made by the Packrite Company of Nicholson, Wis.

It would be desirable to apply to these systems some technique for attaching advertising, coupons, or other information to the bag other than printing on the face of the bag itself, without interfering with a fully automated manufacturing process for making and filling the bags.

By this invention, such a fully automated manufacturing process can be provided, while at the same time a so-called "header" can be provided to one end of the bag, typically the top in position of use, which header may contain a label if desired, or a brochure, coupons, or the like, which are separated from the bag contents.

DESCRIPTION OF THE INVENTION

By this invention, a method of bagging produce is provided, which comprises the following steps. One advances a pair of thermoplastic sheets having upper and lower edges in parallel, abutting relation along a process line. A longitudinal seal line is formed, typically by heat sealing, between the sheets near to, but spaced from, their lower edges to define a bag header of the type described above, by forming an isolated end section of the bag which does not communicate with the central produce-holding portion thereof.

Transverse slits are formed in both of the sheets together, and the edges of the slits are heat sealed to form separate bags between the slits. By such heat sealing of the edges of the respective sheets, newly formed bags are defined between the slits. The slits which are formed extend across the lower edges of the sheets, but are spaced from the upper edges thereof, so that the structure remains an integral structure of connected bags.

The produce (including ice as an option) may then be dropped between the thermoplastic sheet upper edges into the bags, since the bags are now closed on three sides: the bottom side (which will ultimately be the top of the bag) having the longitudinal seal line described above, and the two lateral sides of the bag, which have been sealed by the heat sealing of the slit edges. Then, one heat seals the bag on the upper edges thereof.

At some time in the process, typically after the produce has been added, the bags are separated.

Specifically, the bags may be separated by horizontally slitting to substantially intersect the transverse slits, and to separate a horizontal strip of the sheets including the upper edges, while bottom-supporting the bags. Then, the step of upper edge heat sealing described above takes place along the new, upper edge formed by such horizontal slitting. The bags are preferably mechanically retained adjacent to their upper edges as the heat sealing takes place.

The respective longitudinal seal lines may be formed in the plastic sheets by pressing together hot, longitudinal sealing bars, each having a sheet-contacting width of ⅛ to ⅜ inch, with the thermoplastic sheets being positioned between the bars.

Also, the upper edge heat sealing step preferably takes place after the horizontal slitting step when that step is used, so that the slitting process is not interfered with by residual heat remaining in the bag material from the heat sealing step, which could cause the bag material to be somewhat soft and of the consistency of taffy, giving undesirable results in the slitting. Thus, the process line can be shortened since there is no need for an added length of the process line to be dedicated to time for allowing the bags to cool.

The thermoplastic sheets used herein to manufacture the bags may comprise a single master sheet if desired, folded to define the pair of sheets along a longitudinal fold line at the lower edges. This can save the need to form another heat seal line at the lower edges of the bags.

Thus, by this invention, a bag with a header is prepared for the first time with a bottom fill technique (referring to the bag in its normal position of use), on a fully automated basis for the handling and storage of produce. This is especially suitable for smaller bags having no dimension larger than eighteen inches: for example 7×13 inch bags, etc.

DESCRIPTION OF SPECIFIC EMBODIMENTS

Figure 1:
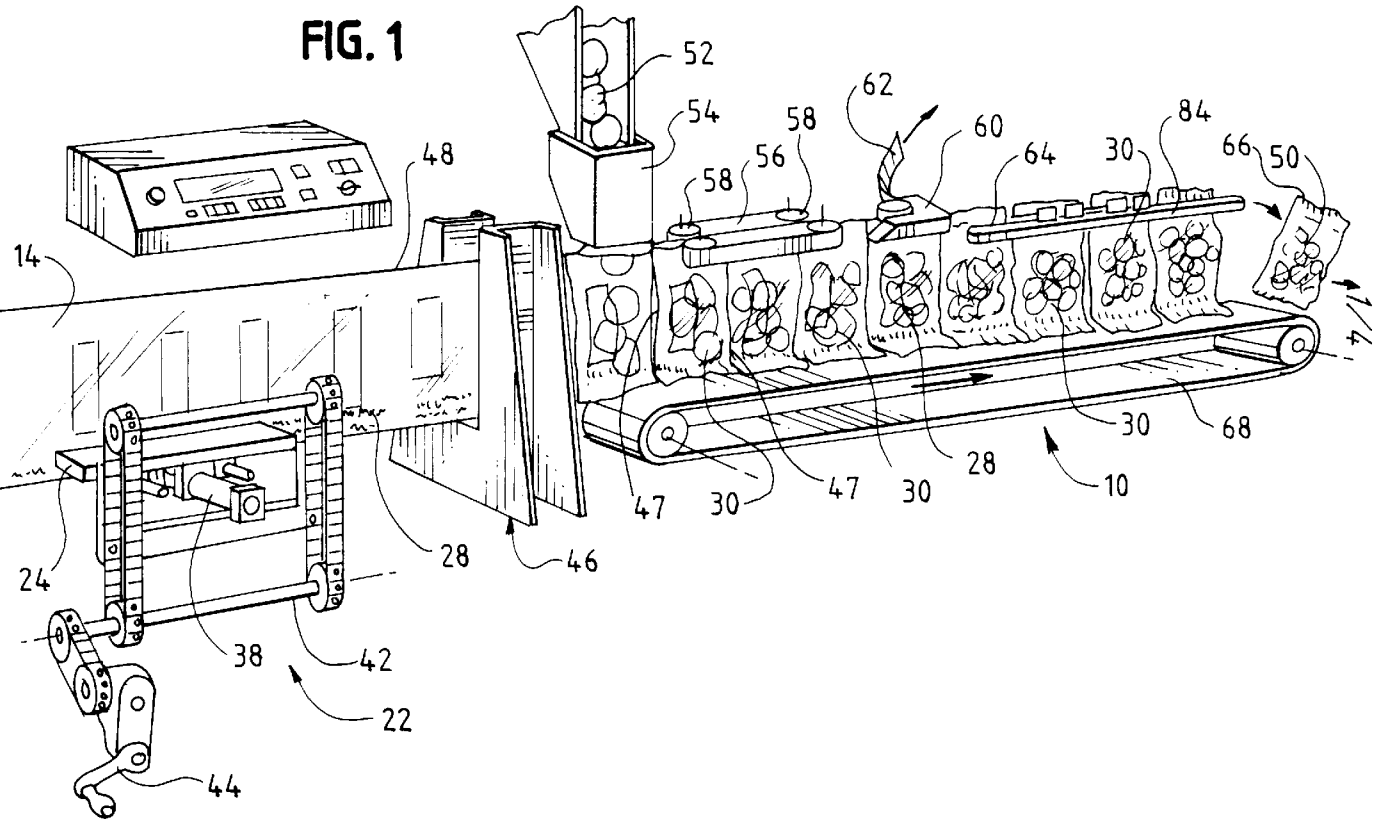
FIG. 1 is a perspective view of a process line for performing the invention of this application.

Referring to the drawings, FIG. 1 shows a process line 10 for manufacturing bags in accordance with this invention. A spool of thermoplastic sheeting 12 such as polyethylene is provided, with the sheeting being folded double to form two parallel, abutting sheeting sections 14, 16 connected at their bottom edge 18 by a fold line.

Control rollers 20 are conventionally provided to maintain a desired tension of sheeting 12 along process line 10.

Figure 2:
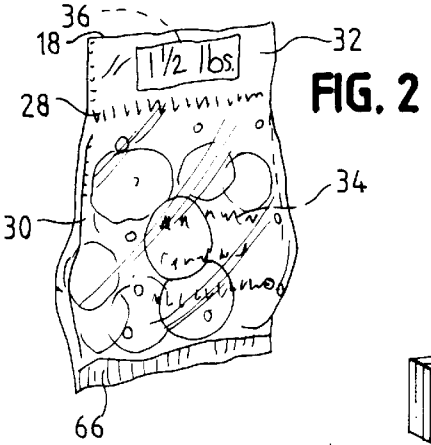
FIG. 2 is a perspective view of a filled bag produced by the process of this invention, shown in right side up position.
Figure 3:
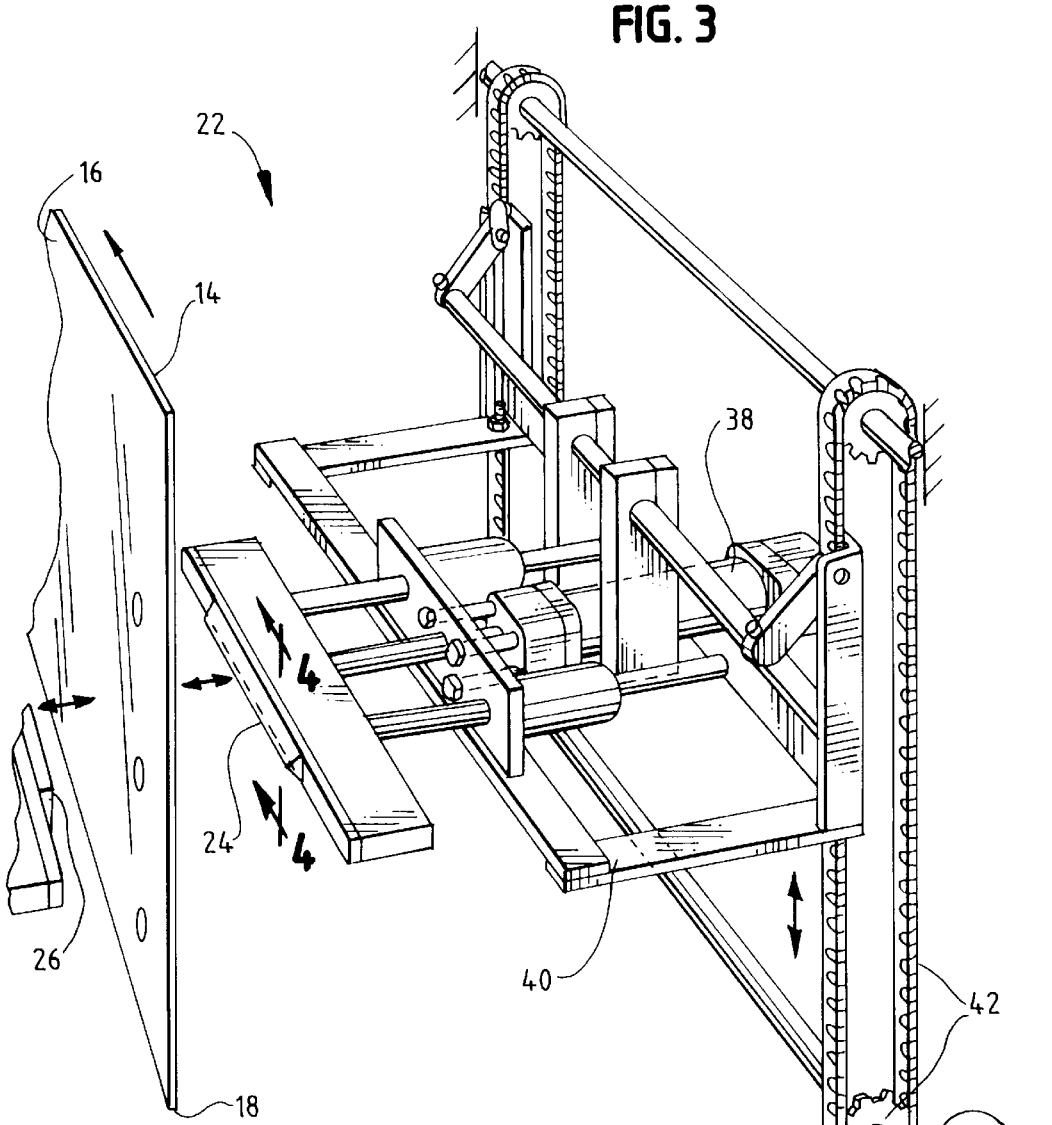
FIG. 3 shows a perspective view of parts of the heat sealing station of the process line of FIG. 1 in which the "header" of the bag is defined.
Figure 4:
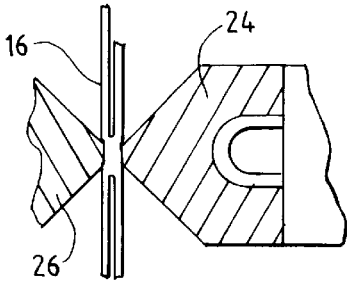
FIG. 4 is a sectional view taken along line 4—4 of FIG. 3.
Figure 8:
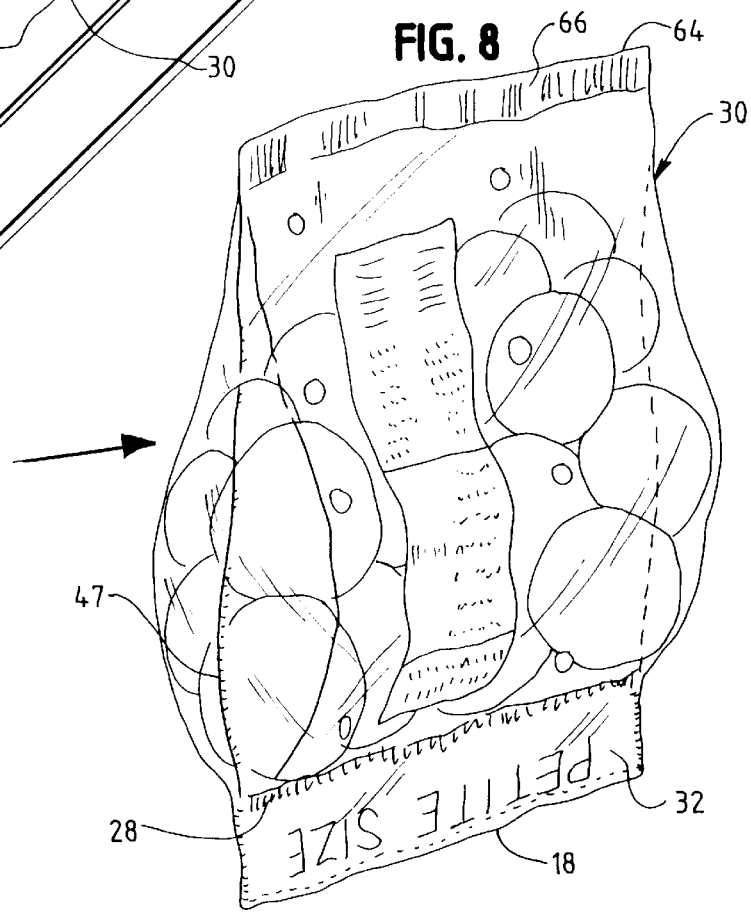
FIG. 8 shows a filled produce bag as it comes off of the process line in inverted position.

The double pair of sheeting sections 14, 16 are then advanced in abutting, lying-together relation through a longitudinal seal line-applying station 22 which comprises a heated pair of seal bars 24, 26 as particularly shown in FIGS. 3 and 4, to form longitudinal seal line 28 in the respective, formed bags 30 as shown particularly in the finished products of FIGS. 2 and 8. Thus, header 32 is formed, comprising a portion of the thermoplastic sheets 14, 16, which is isolated by seal line 28 from the main bag interior chamber 34 and the produce stored therein, to form a separate compartment which can receive by conventional automated insertion a label 36, a coupon, an identification tag, or other portions of printed matter if desired. The top of header 32 is sealed by fold line 18, which in the process line of FIG. 1 is at the bottom of the pair of thermoplastic sheets 14, 16.

Alternatively, separate thermoplastic sheets may be processed in accordance with this invention, but, typically, it would then be desirable to provide a heat seal line in the vicinity of where fold line 18 resides in the specific embodiment shown.

Heat seal bar 24 has an adjustable position as shown, being movable horizontally by the action of piston and cylinder 38, which is carried on frame 40. Frame 40 may be adjusted upwardly and downwardly by the action of sprocket chains and gears 42, and rotary handle 42. Heat seal bar 24 may be heated with internal electric coils or some other conventional means.

Conventional polyethylene sheeting may be used for this process. Also, holes may be punched in the body of the sheeting as desired to provide adequate ventilation for the produce inside.

Then, the advancing sheets 14, 16 connected by horizontal seal line 28, are advanced to a transverse slitting and sealing station 46. This station may basically comprise a hot knife that forms transverse slits which extend through lower folded edge 18 of the plastic sheeting 12, but are spaced from the upper edge 48 of sheeting 12 so that the sheeting 12 remains an integral structure. At the same time, the hot knife at slitting station 46 causes the edges of the respective bags 30 defined between the slits 47 of sheet portions 14, 16, to seal together, so that the newly formed bags 30 are sealed at their sides. Such a hot knife system 46 usable as transverse slitting station 46 may be purchased from the Ban Rite Company of Nicholson, Wis.

Then, produce 52 may be placed in each bag 50 through chute 54 as each bag moves downstream along the lines. Chute 54 may have a portion that fits between the respective sheets 14, 16 since the upper end 48 of the respective sheeting 12 and bags 30 remains open at this moment, in accordance with the design of the form and fill machine of the Affeldt Company, for example.

As the filled bags 30 continue to move downstream, their tops are caught and pressed together by rotating belts 56 to provide the bags with a smooth, taut upper edge. Driver rollers 58 operate belts 56 to assist in this process.

Then, preferably, a portion of the respective sheeting and bags adjacent to upper edge 48 is cut away at a longitudinal or horizontal cutting station 60, with the resulting upper strip 62 incorporating the original upper edge 48 being discarded. This horizontal cut is positioned to at least almost intersect transverse cuts 47, so that the bags 30 separate or become easily separable from each other. Promptly thereafter, the new upper edge 64 of the respective bags 30 passes into a second, longitudinal sealing station, which may be a band sealer machine of the Packrite Company as previously described, to provide a horizontal seal line 66 to the bag at its upper end opposed to header 32. From there, the completed bag can be deposited in a receptacle or a pallet for shipment of multiple bag loads.

Also, a conveyer belt 68 is provided from the position 54 where the respective bags are filled with produce 52 to the end of the line, to assist in bearing the load of the bags, so that the tension on the bag end opposed to header 32 and on the forming heat seal 66 can be minimized.

Figures 5, 6:
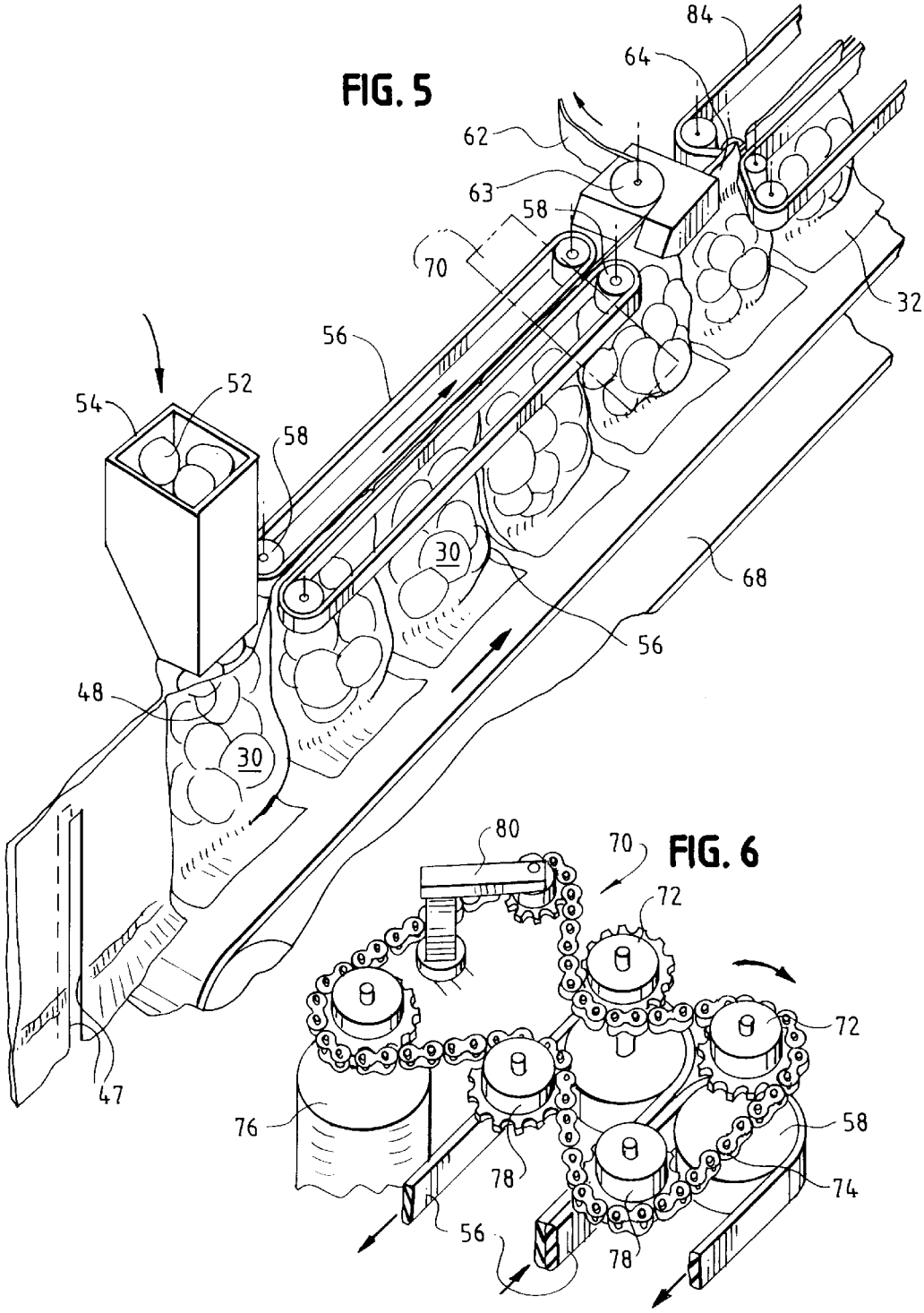
FIG. 5 is a perspective view of the filling, longitudinal slitting, and bag end sealing stations of the process line of FIG. 1, shown to be downstream from the filling station.
FIG. 6 is a fragmentary, perspective view showing the gearing system for controlling the belts and motors for advancing the filled bags to the slitting and bottom-sealing station.
Figure 7:
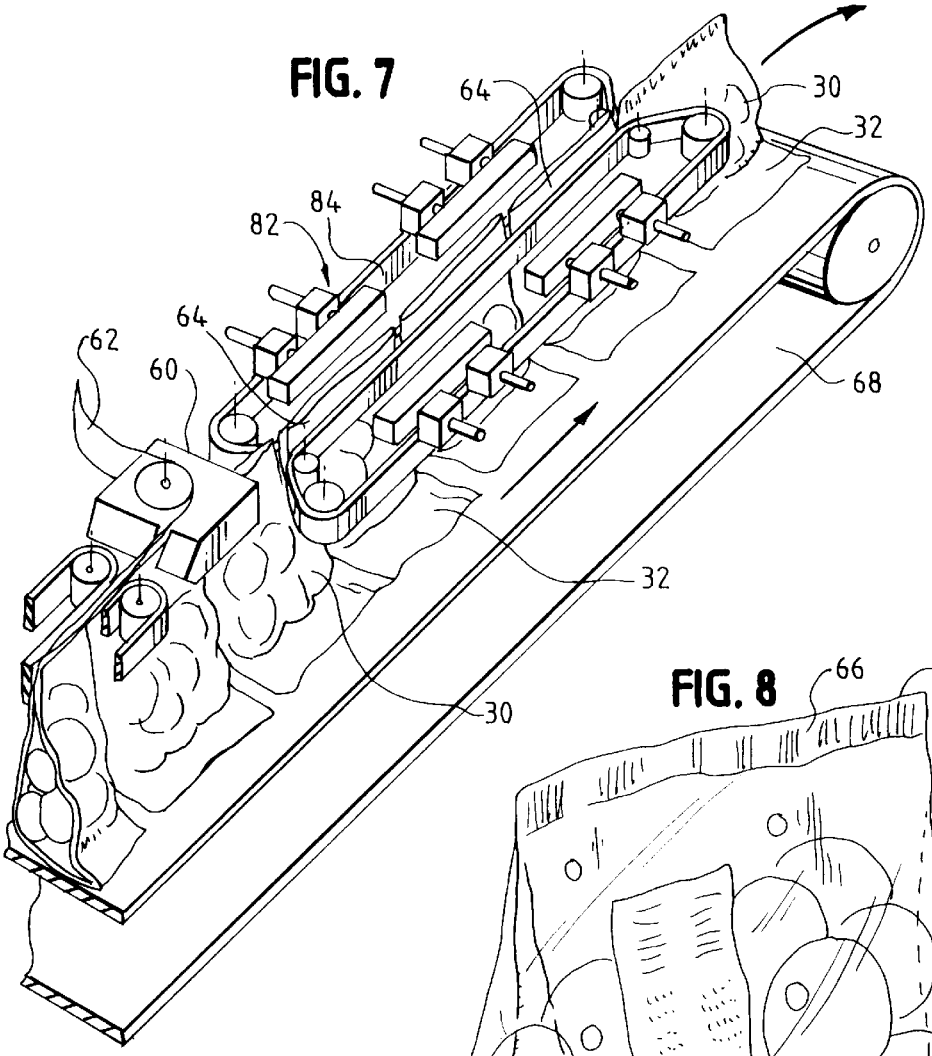
FIG. 7 shows a perspective view of the end of the process line.

Belts 56 which grip the ends of bags 30 and advance them from the produce loading station 54 to the horizontal slitting station 62, with the aid of belt 68, may be controlled by a sprocket and chain assembly 70 as particularly shown in FIG. 6, being positioned above belts 56 as shown in FIG. 5. The respective belts 56 are driven by the gearing system shown, with belt gears 72, being connected by a chain 74 to motor and gear 76. Idler gears 78 and 80 are also provided for the maintenance of proper belt action and tension. The speed of lower support belt 68 can be correspondingly controlled in conventional manner to match the speed of belts 56.

The bags finally pass through the horizontal sealing system 82 that forms transverse end seal line 66 in each bag, using conventional heat sealing devices, with the bag ends 64 being advanced and held together by a belt system 84, which may be similar in structure and operation to belt system 56.

Thus, the respective finished bags 30 are formed, filled, separated, and deposited to a pallet or other container, for the first time on a fully automated basis, while the bags are additionally formed to carry a header 32 which may contain a label, sales literature, or the like.

The above has been offered for illustrative purposed only, and is not intended to limit the scope of this application, which is as defined in the claims below.

That which is claimed is:

1. The method of bagging produce, which comprises:

advancing a pair of thermoplastic sheets having upper and lower edges along a process line;

forming a longitudinal seal line between said sheets near to but spaced from said lower edges to define a bag header;

forming transverse slits in both of said sheets together, and heat sealing edges of said slits to form separate bags between said slits, said slits extending across said lower edges but being spaced from said upper edges;

dropping produce between thermoplastic sheet upper edges into said bags;

heat sealing the bags along the upper edges thereof; and horizontally slitting said bags to substantially intersect said transverse slits and to separate a horizontal strip of said sheets including said upper edges, while bottom-supporting said bags, said upper edge heat sealing of said bags taking place along the new upper edge formed by said horizontal slitting after said horizontal slitting step.

2. The method of claim 1 in which said sheets comprise a single master sheet, folded to define said pair of sheets along a longitudinal fold line at said lower edges.

3. The method of claim 1 in which said longitudinal seal line is formed by pressing together hot, longitudinal seal bars, each having a sheet-contacting width of ⅛ to ⅜ inch, with said thermoplastic sheets being positioned between said bars.

4. The method of claim 1 in which said produce comprises potatoes, onions, or apples.

5. The step of claim 1 in which said horizontal slitting takes place after said dropping of produce into said bags.

6. The method of bagging produce which comprises:

advancing a pair of thermoplastic sheets having upper and lower edges along a process line;

forming a longitudinal seal line between said sheets near to but spaced from said lower edges to define a bag header, said longitudinal seal line being formed by pressing together hot, longitudinal seal bars, each having a sheet-contacting width of ⅛ to ⅜ inch, with said thermoplastic sheets being positioned between said bars;

forming transverse slits in both of said sheets together, and heat sealing edges of said slits to form separate bags between said slits, said slits extending across said lower edges but being spaced from said upper edges;

dropping produce between thermoplastic sheet upper edges into said bags;

horizontally slitting said bags to substantially intersect said transverse slits and to separate a horizontal strip of said sheets including said upper edges, while bottom-supporting said bags; and heat sealing the bags along the new upper edges formed by said horizontal slitting, said upper edge heat sealing step taking place after said horizontal slitting step.

7. The method of claim 6 in which said sheets comprise a single master sheet folded to define said pair of sheets along a longitudinal fold line at said lower edges.

* * * * *